US010234236B2

(12) United States Patent
Patterson

(10) Patent No.: US 10,234,236 B2
(45) Date of Patent: Mar. 19, 2019

(54) CONCEALED CARGO CARRY SYSTEM

(71) Applicant: Edward Albert Patterson, Redding, CA (US)

(72) Inventor: Edward Albert Patterson, Redding, CA (US)

( * ) Notice: Subject to any disclaimer, the term of this patent is extended or adjusted under 35 U.S.C. 154(b) by 86 days.

(21) Appl. No.: 15/417,046

(22) Filed: Jan. 26, 2017

(65) Prior Publication Data

US 2017/0227325 A1 Aug. 10, 2017

Related U.S. Application Data

(60) Provisional application No. 62/292,903, filed on Feb. 9, 2016.

(51) Int. Cl.
*F41C 33/00* (2006.01)
*F41C 33/04* (2006.01)
*F41C 33/06* (2006.01)

(52) U.S. Cl.
CPC ..... *F41C 33/048* (2013.01); *F41C 33/06* (2013.01)

(58) Field of Classification Search
CPC ..... F41A 23/18; F41A 23/23; F41A 23/52; F41A 23/00; F41C 33/04; F41C 33/048; F41C 33/00
USPC ..... 248/298.1, 220.21, 220.22, 346.03, 248/346.07, 354.3, 354.4; 42/94
See application file for complete search history.

(56) References Cited

U.S. PATENT DOCUMENTS 4,438,913 A * 3/1984 Hylla ..... F41A 23/18 248/534
4,993,670 A * 2/1991 Tesar ..... F16L 3/1091 248/68.1
5,529,273 A * 6/1996 Benthin ..... A47H 1/142 160/902
6,398,174 B1 * 6/2002 Emalfarb ..... A47G 7/044 248/214
7,584,690 B2 * 9/2009 Cauley ..... F41A 23/18 42/94
2012/0068027 A1 * 3/2012 Tyner ..... A47F 1/04 248/201

* cited by examiner

*Primary Examiner* — Steven M Marsh

(57) ABSTRACT

A concealed cargo carry system is used to holster, conceal, and surface mount a firearm. The system includes a first L-shaped bracket and a second L-shaped bracket which are slidably engaged with each other through a bracket adjustment mechanism. This allows the first L-shaped bracket and the second L-shaped bracket to be adjusted to fit firearms and clothing applications of varying types. The first L-shaped bracket and the second L-shaped bracket frame the firearm, concealing the shape of the firearm when carried in a bag or clothing. The system also includes a barrel support which is mounted onto the base member of the first L-shaped bracket. The barrel support is used to securely mount the firearm onto the system. The system also includes a receiver unit which engages with the first L-shaped bracket and the second L-shaped bracket to attach additional mounting components to the system for expanded carry applications.

5 Claims, 10 Drawing Sheets

CONCEALED CARGO CARRY SYSTEM

The current application claims a priority to the U.S. Provisional Patent application Ser. No. 62/292,903 filed on Feb. 9, 2016.

FIELD OF THE INVENTION

The present invention relates generally to concealed carry gun holsters and accompanying accessories. More particularly, the present invention is a concealed carry system which is used to conceal a firearm in "cargo" style and similar clothing or within a bag. Further, the concealed cargo carry system may be used to mount a firearm onto an object or surface.

BACKGROUND OF THE INVENTION

Holsters and gun mounts are commonly used to carry or store firearms. Though many pocket carry holsters are effective in carrying and concealing firearms, most pocket carry holsters are designed to fit specific gun models and calibers and cannot be used with a wide range of firearms. Furthermore, most holsters do not provide the added ability to be mounted onto an object or surface. Conversely, while many existing mounting products may provide this functionality, they cannot also be used as a pocket carry holster.

Accordingly, there is a present need for a system which can be used for concealed pocket carry and as a mount for a firearm. The present invention is such a concealed carry and mounting system. The system comprises two L-shaped brackets which are slidably engaged with each other through a bracket-adjustment mechanism. This allows the system to be adjusted to fit firearms and clothing of varying types. The system also includes a receiver unit which allows the L-shaped brackets to be mounted in various ways. The receiver unit attaches onto the L-shaped brackets, holding the L-shaped brackets in an upright position. A support bar or an angled insert may be attached onto the receiver unit in order to provide additional mounting options.

DETAILED DESCRIPTION OF THE INVENTION

All illustrations of the drawings are for the purpose of describing selected versions of the present invention and are not intended to limit the scope of the present invention.

Figure 1:
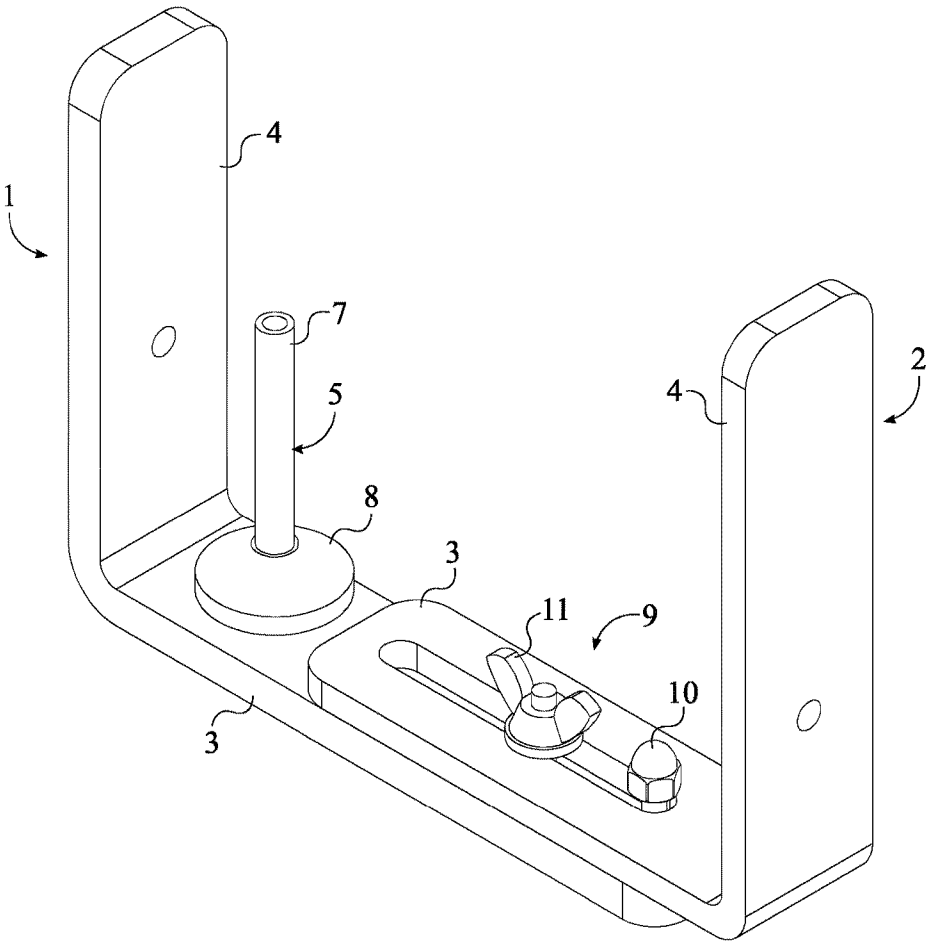
FIG. 1 is a front perspective view of the present invention.
Figure 2:
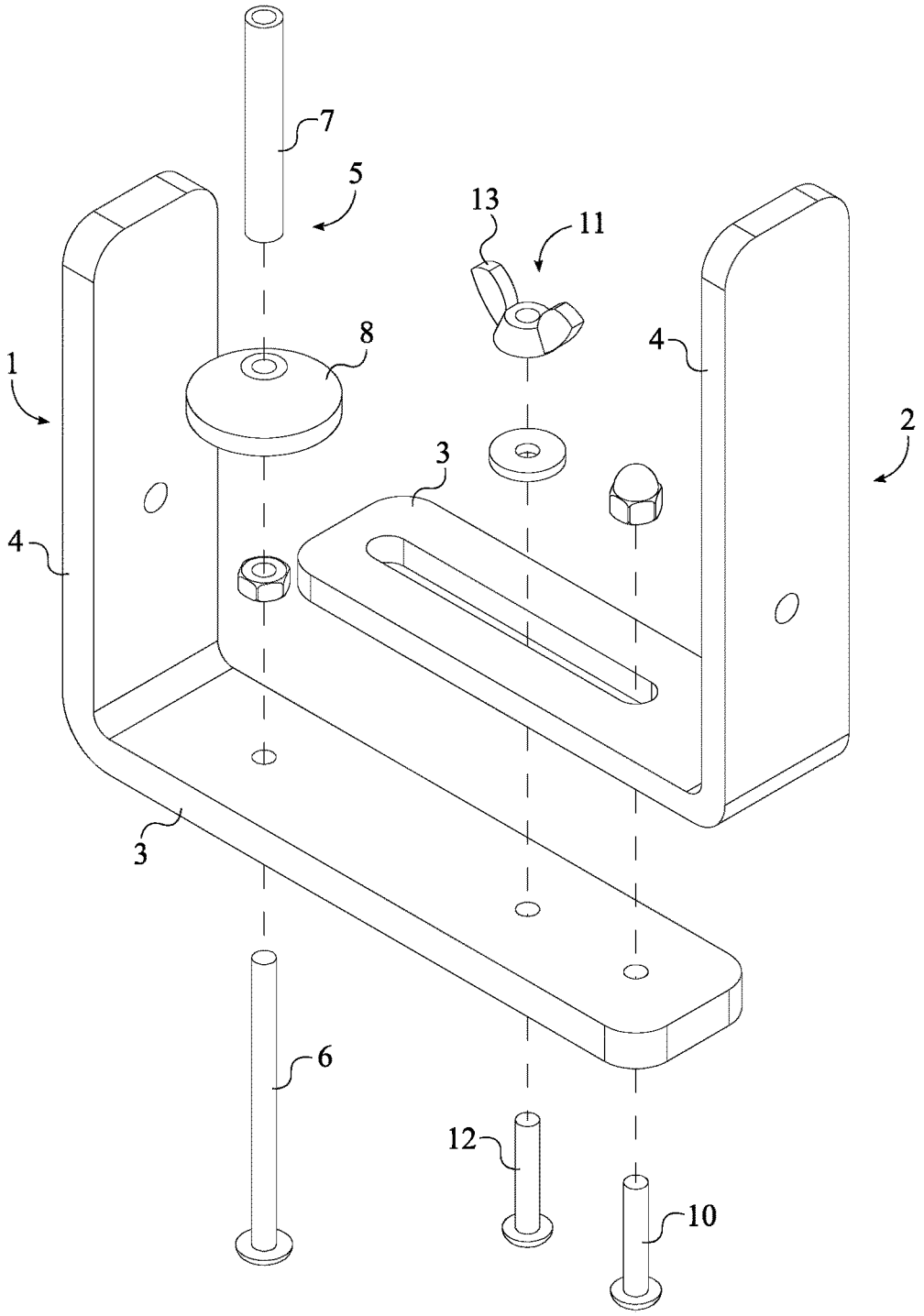
FIG. 2 is an exploded front perspective view of the present invention.

With reference to FIGS. 1-2, the present invention is a concealed cargo carry system that may be used for holstering and concealing a firearm. The system may also be used for storing a firearm in a bag or purse, or may be used to mount the fire arm to a surface. Furthermore, the present invention provides both left and right-handed accessibility, depending on the needs of the user. The present invention comprises a first L-shaped bracket 1, a second L-shaped bracket 2, a barrel support 5, and a bracket-adjustment mechanism 9. The first L-shaped bracket 1 and the second L-shaped bracket 2 are used to support a firearm and conceal the shape of the firearm. In the preferred embodiment of the present invention, the first L-shaped bracket 1 and the second L-shaped bracket 2 are made from a durable plastic which is able to flex for added comfort. The first L-shaped bracket 1 and the second L-shaped bracket 2 each comprise a base member 3 and a lateral member 4. The lateral member 4 is connected perpendicular to the base member 3. The lateral member 4 is terminally positioned on the base member 3. The lateral member 4 of the second L-shaped bracket 2 is positioned opposite to the lateral member 4 of the first L-shaped bracket 1. This arrangement allows the shape of the firearm to be disguised in between the lateral portion of the first L-shaped bracket 1 and the lateral portion of the second L-shaped bracket 2. The base member 3 of the first L-shaped bracket 1 is slidably engaged with the base member 3 of the second L-shaped bracket 2 through the bracket-adjustment mechanism 9. This arrangement allows the positioning of the first L-shaped bracket 1 and the second L-shaped bracket 2 to be adjusted to fit firearms and clothing of varying types. The barrel support 5 is connected perpendicular to the base member 3 of the first L-shaped bracket 1. The barrel support 5 is used to secure the firearm onto the present invention. To attach the firearm to the present invention, the barrel of the firearm is slid onto the barrel support 5 such that the barrel encircles the barrel support 5. The barrel support 5 is positioned in between the base member 3 of the second L-shaped bracket 2 and the lateral member 4 of the first L-shaped bracket 1. This arrangement is used to mount the firearm such that the barrel or slide of the firearm is positioned adjacent to lateral member 4 of the first L-shaped bracket 1 and the butt of the firearm is positioned adjacent to the lateral member 4 of the second L-shaped bracket 2.

In reference to FIG. 2, the bracket-adjustment mechanism 9 comprises a sliding bolt 10 and a bracket fastener 11. The sliding bolt 10 permits the first L-shaped bracket 1 and the second L-shaped bracket 2 to slide relative to each other. To do this, the sliding bolt 10 is mounted perpendicular to the base member 3 of the first L-shaped bracket 1 and the base member 3 of the second L-shaped bracket 2 is slidably engaged with the sliding bolt 10. A bolt cap may be terminally connected to the sliding bolt 10 in order to prevent the second L-shaped bracket 2 from becoming dislodged from the sliding bolt 10. The bracket fastener 11 is engaged with the base member 3 of the first L-shaped bracket 1 and the base member 3 of the second L-shaped bracket 2. The bracket fastener 11 is used to lock the positioning of the second L-shaped bracket 2 relative to the first L-shaped bracket 1.

In reference to FIG. 2, the bracket fastener 11 comprises a locking bolt 12 and a wing nut 13. Similar to the sliding bolt 10, the locking bolt 12 is mounted normal to the base member 3 of the first L-shaped bracket 1. The base member 3 of the second L-shaped bracket 2 is slidably engaged with the locking bolt 12. The wing nut 13 is engaged with the locking bolt 12 and is tightened to lock the first L-shaped bracket 1 and the second L-shaped bracket 2 in position. The wing nut 13 is positioned adjacent to the base member 3 of the second L-shaped bracket 2, opposite to the base member 3 of the first L-shaped bracket 1. When tightened, the wing nut 13 presses the base of the first L-shaped bracket 1 and the base of the second L-shaped bracket 2 against each other.

In reference to FIG. 2, the barrel support 5 comprises a support rod 6, a rod grip 7, and a nose protector 8. The support rod 6 is connected perpendicular to the base member 3 of the first L-shaped bracket 1. The support rod 6 is used to mount a firearm onto the present invention. The rod grip 7 is laterally connected around the support rod 6. The rod grip 7 creates a protective barrier around the support rod 6 that limits wear to the inside of the barrel of the firearm and prevents the firearm from slipping off of the support rod 6. The nose protector 8 is laterally connected around the support rod 6 and is positioned in between the rod grip 7 and the base member 3 of the first L-shaped bracket 1. The nose protector 8 acts as a rest for the nose of the firearm's barrel. The nose protector 8 also helps to center the firearm on the support rod 6 and limit wear on the nose of the firearm's barrel.

Figure 3:
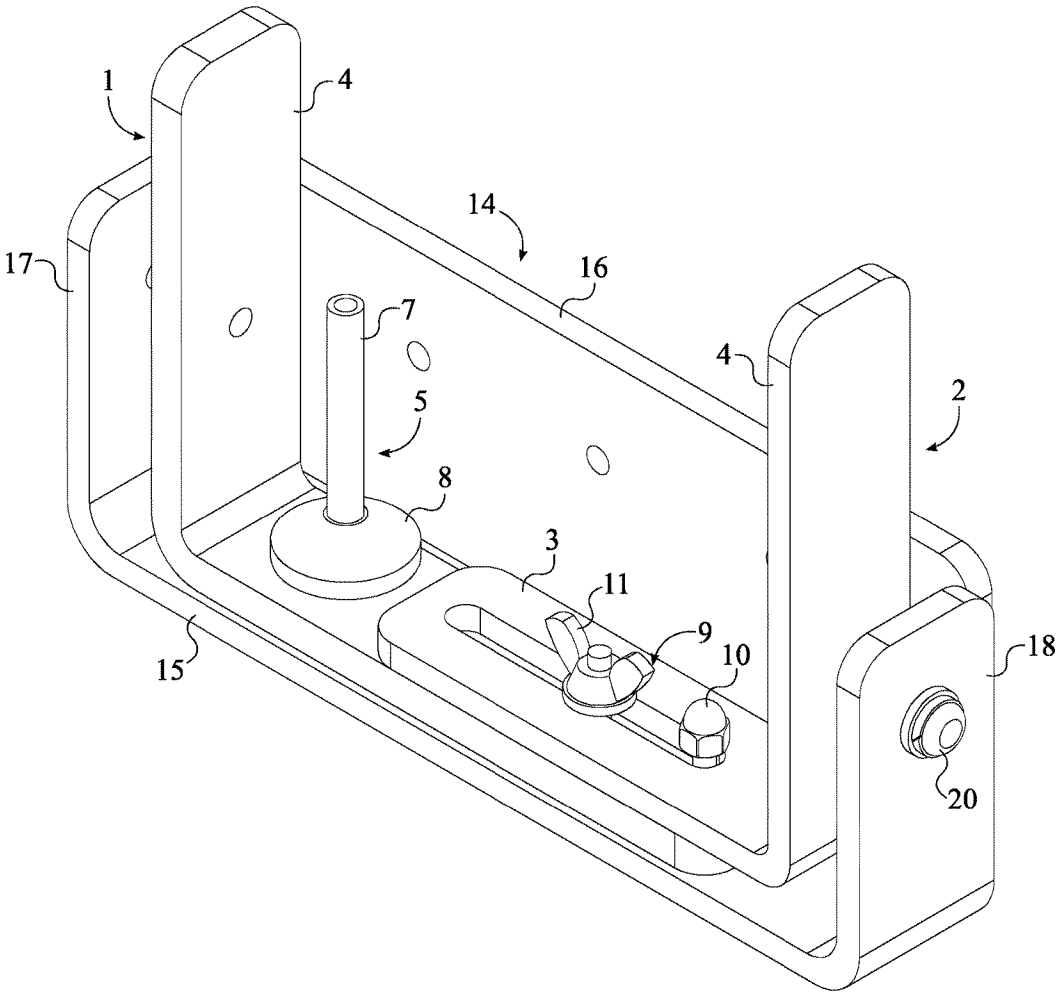
FIG. 3 is a front perspective view of the present invention with the receiver unit.
Figure 4:
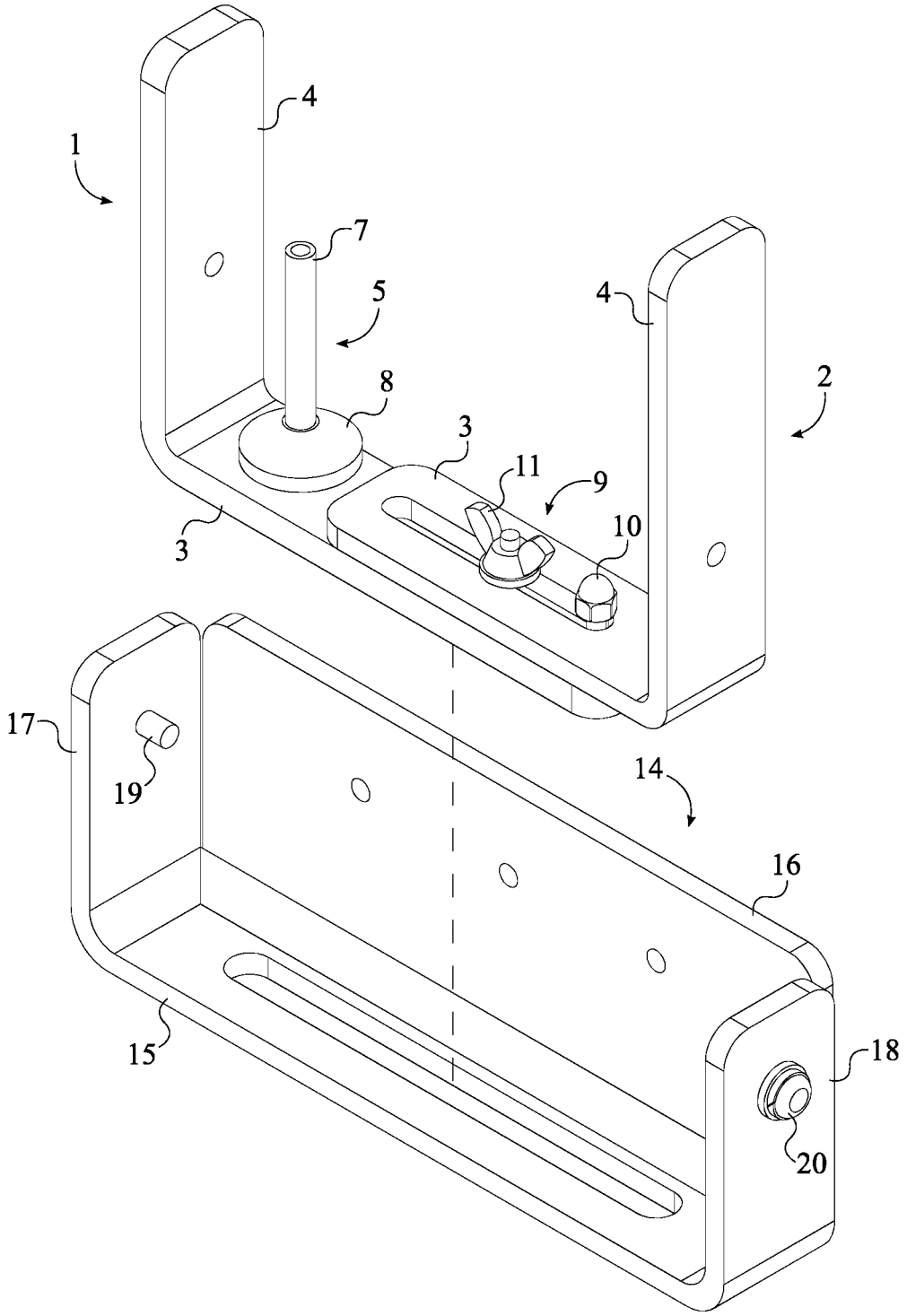
FIG. 4 is an exploded front perspective view of the present invention with the receiver unit.

In reference to FIGS. 3-4, the present invention further comprises a receiver unit 14. The receiver unit 14 is designed to attach onto the first L-shaped bracket 1 and the second L-shaped bracket 2 in order to hold the first L-shaped bracket 1 and the second L-shaped bracket 2 in an upright position. The receiver unit 14 is also used to secure additional components to the first L-shaped bracket 1 and the second L-shaped bracket 2. The receiver unit 14 comprises a receiver base 15, a back panel 16, a first lateral panel 17, a second lateral panel 18, a first receiver peg 19, and a second receiver peg 20. The first lateral panel 17 is connected normal to the receiver base 15. The second lateral panel 18 is connected normal to the receiver base 15. In the preferred embodiment of the present invention, a slot traverses through the receiver base 15. The slot provides room for the bracket-adjustment mechanism 9 and the barrel support 5 so that the base member 3 of the first L-shaped bracket 1 may be positioned flush against and pinned into the receiver base 15. The first lateral panel 17 and the second lateral panel 18 are positioned opposite to each other along the receiver base 15. This arrangement allows the first lateral panel 17 and the second lateral panel 18 to reinforce the lateral member 4 of the first L-shaped bracket 1 and the lateral member 4 of the second L-shaped bracket 2 respectively. The back panel 16 is connected normal to the receiver base 15, in between the first lateral panel 17 and the second lateral panel 18. A plurality of mounting holes traverse through the back panel 16 which allow additional components to be mounted onto the receiver unit 14.

Figure 5:
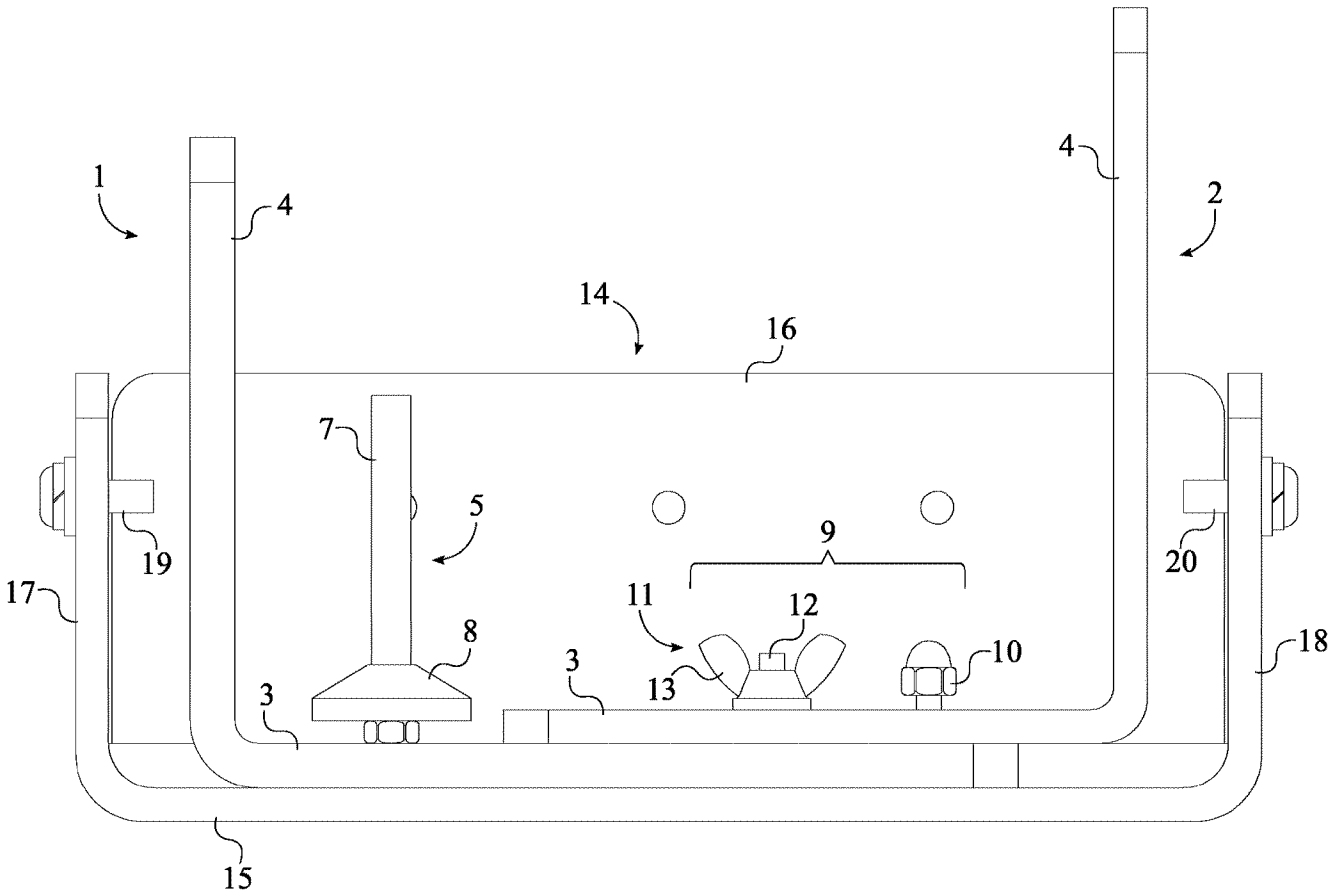
FIG. 5 is a front view of the present invention with the first L-shaped bracket and the second L-shaped bracket in a retracted configuration.
Figure 6:
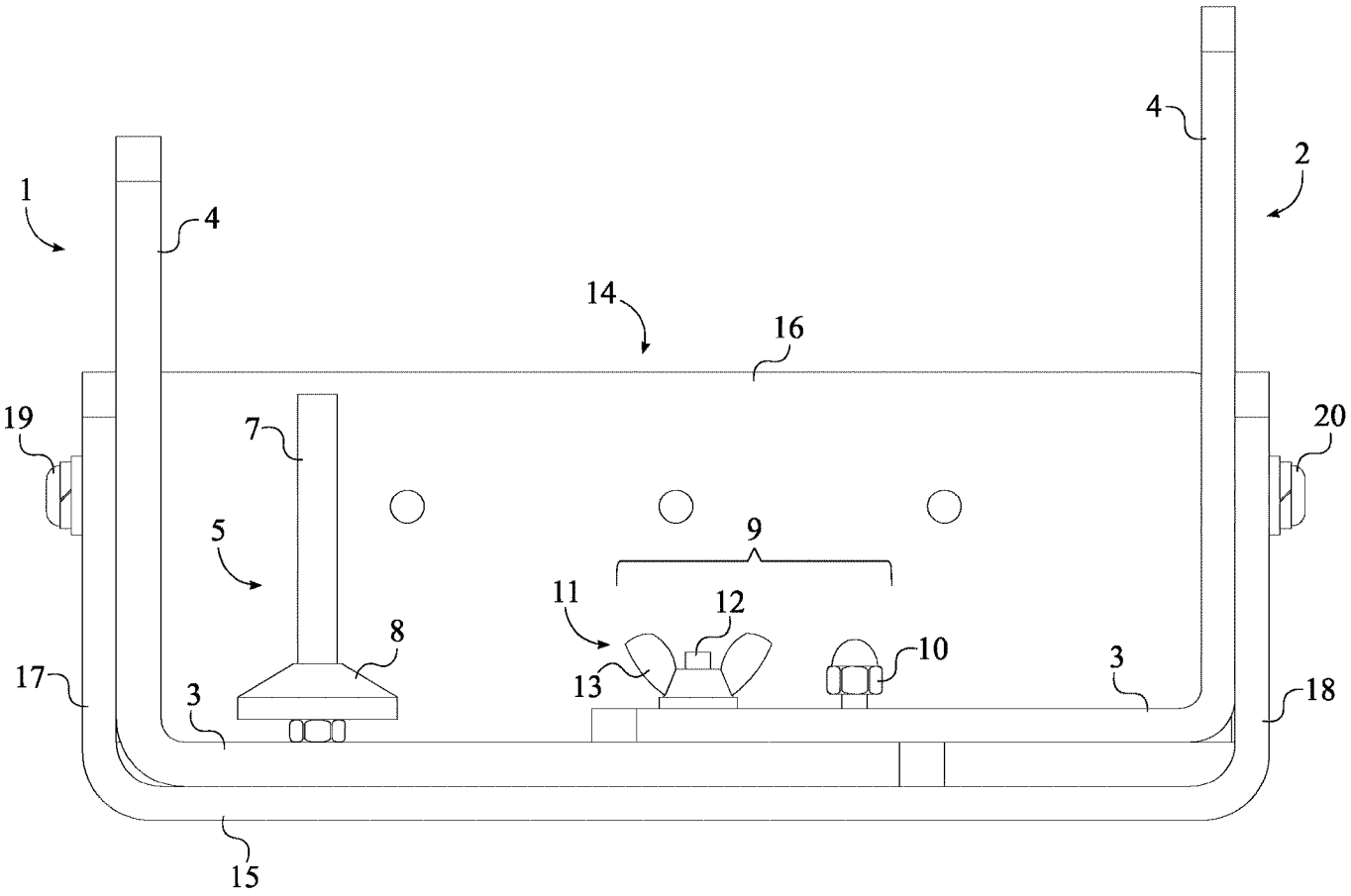
FIG. 6 is a front view of the present invention with the first L-shaped bracket and the second L-shaped bracket in an extended configuration.

In reference to FIGS. 4-5, the first receiver peg 19 and the second receiver peg 20 are used to secure the first L-shaped bracket 1 and the second L-shaped bracket 2 to the receiver unit 14. The first receiver peg 19 is mounted into the first lateral panel 17 and the second receiver peg 20 is mounted into the second lateral panel 18. The first receiver peg 19 and the second receiver peg 20 are oriented towards each other. This arrangement allows the first L-shaped bracket 1 and the second L-shaped bracket 2 to lock onto the first receiver peg 19 and the second receiver peg 20. The first L-shaped bracket 1 and the second L-shaped bracket 2 may be arranged in either a retracted configuration, shown in FIG. 5, or an extended configuration, shown in FIG. 6. When the first L-shaped bracket 1 and the second L-shaped bracket 2 are positioned into the receiver unit 14 and then arranged in the extended configuration, the first receiver peg 19 is engaged with the lateral member 4 of the first L-shaped bracket 1. Similarly, the second receiver peg 20 is engaged with the lateral member 4 of the second L-shaped bracket 2. By tightening the wing nut 13, the first L-shaped bracket 1 and the second L-shaped bracket 2 cannot be removed from the first receiver peg 19 and the second receiver peg 20. If the user wishes to remove the first L-shaped bracket 1 and the second L-shaped bracket 2 from the receiver unit 14, the first L-shaped bracket 1 and the second L-shaped bracket 2 may be slid into the retracted configuration. In doing so, the first L-shaped bracket 1 and the second L-shaped bracket 2, may be easily removed from the first receiver peg 20 and the second receiver peg 21, respectively.

Figure 7:
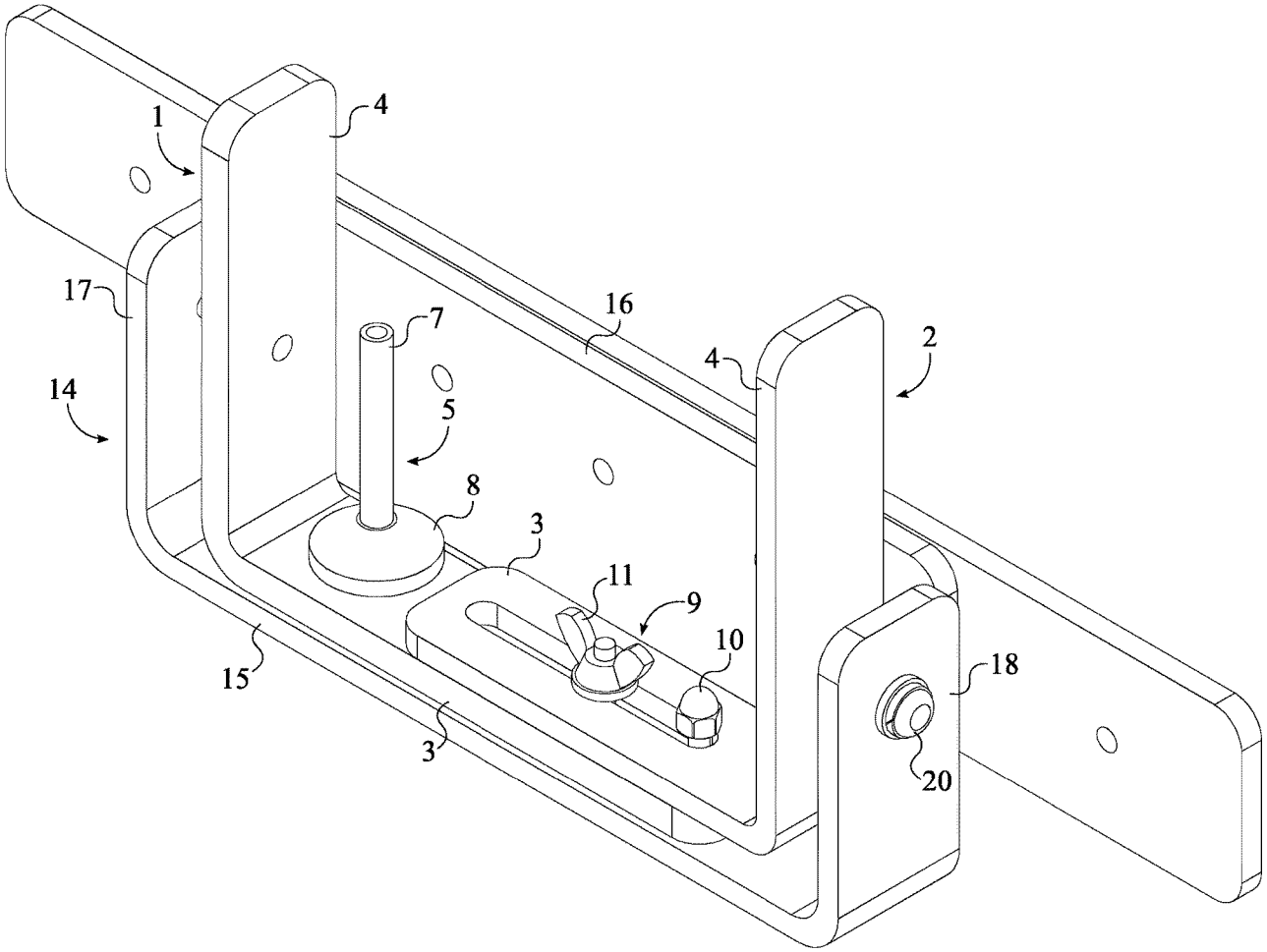
FIG. 7 is a front perspective view of the present invention with the receiver unit and the support bar.
Figure 8:
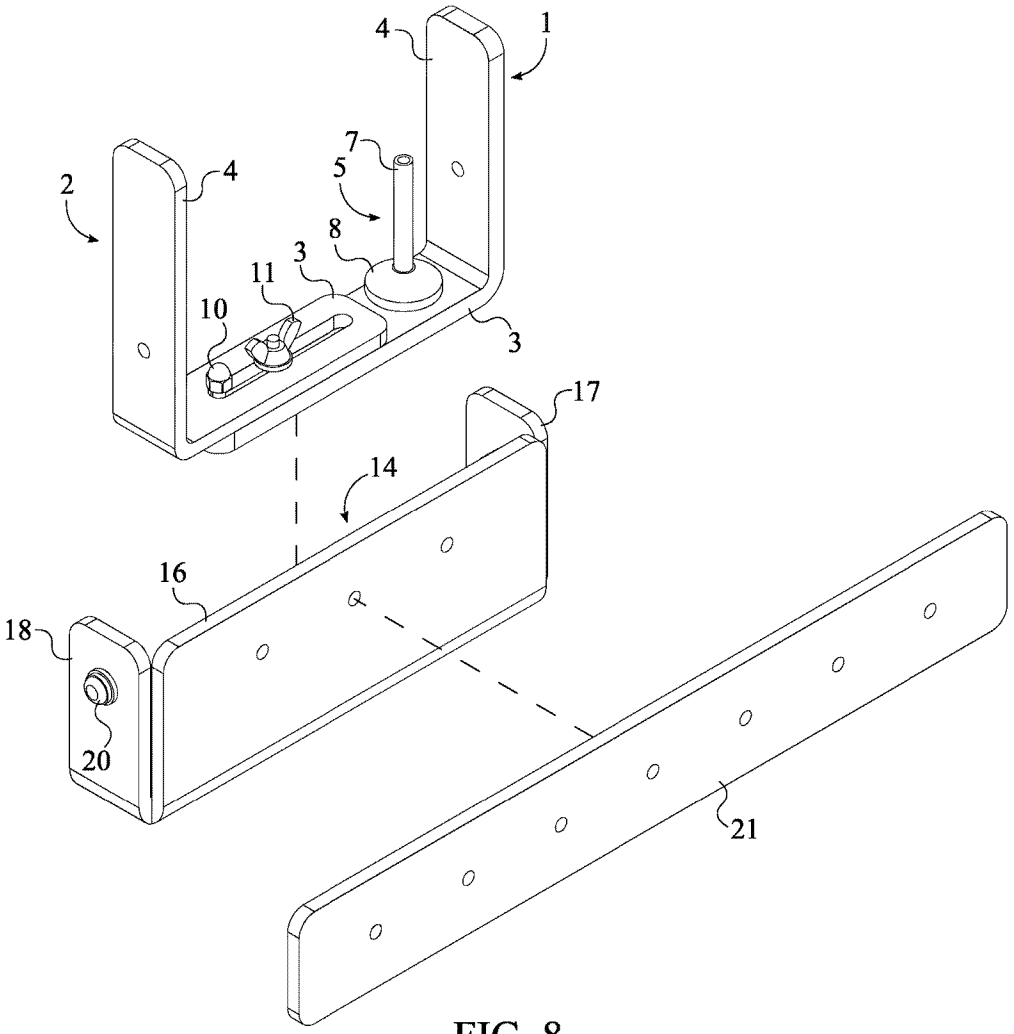
FIG. 8 is an exploded rear perspective view of the present invention with the receiver unit and the support bar.

In reference to FIGS. 7-8, the present invention further comprises a support bar 21 which is laterally mounted to the back panel 16. The support bar 21 is used to properly orient the present invention within a bag or purse. Alternatively, the support bar 21 may be bolted onto a surface, allowing the user to mount a firearm to a wall, a desk, or several other objects. In the preferred embodiment of the present invention, the support bar 21 is bolted to the back panel 16, allowing the user to remove the support bar 21 from the receiver unit 14 if needed. A plurality of bar-mounting holes traverse through support bar 14 and allow the support bar 14 to be mounted to the receiver unit 14 in various manners. This allows the user to utilize the support bar 14 for a variety of mounting applications.

Figure 9:
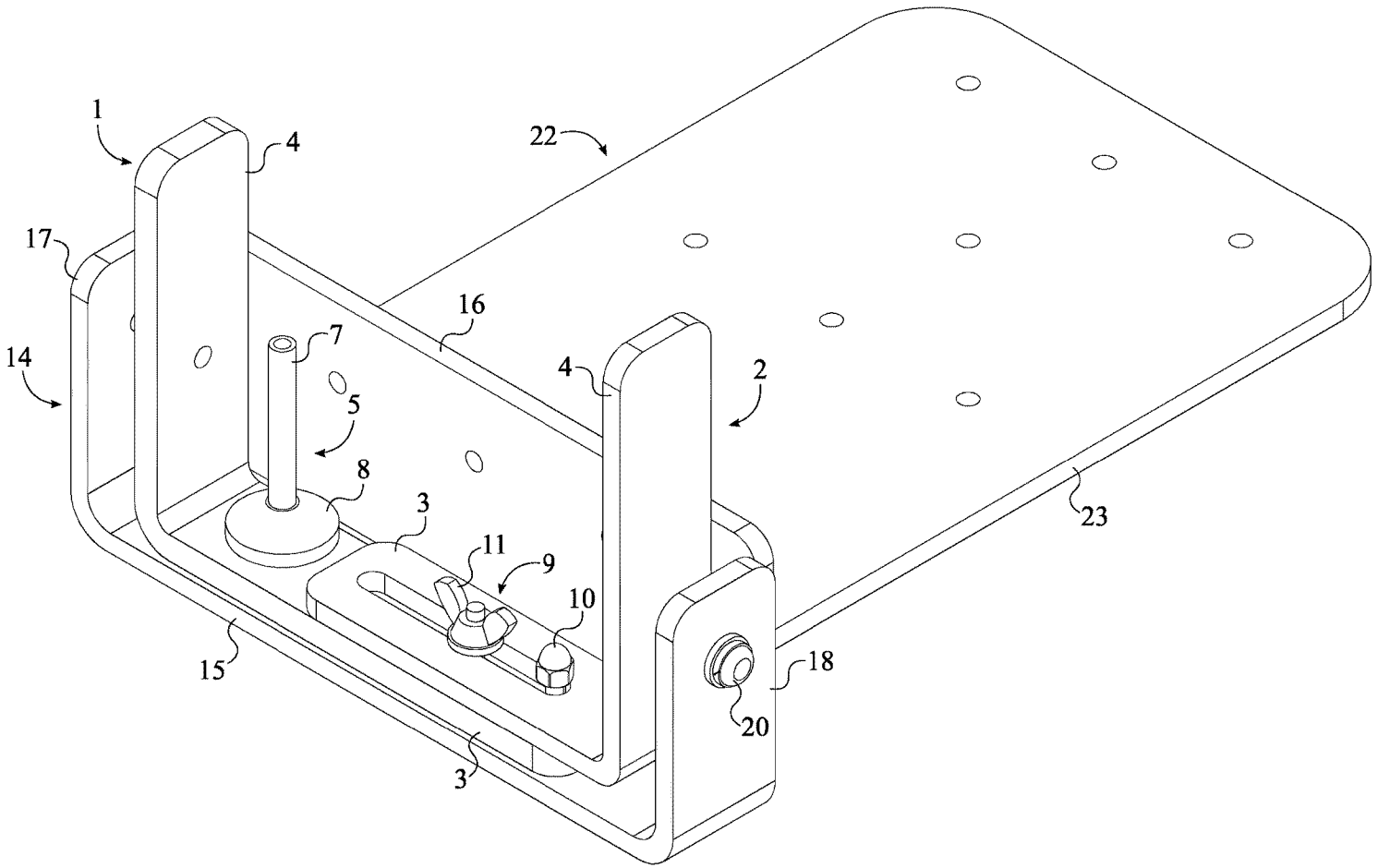
FIG. 9 is a front perspective view of the present invention with the receiver unit and the angled insert.
Figure 10:
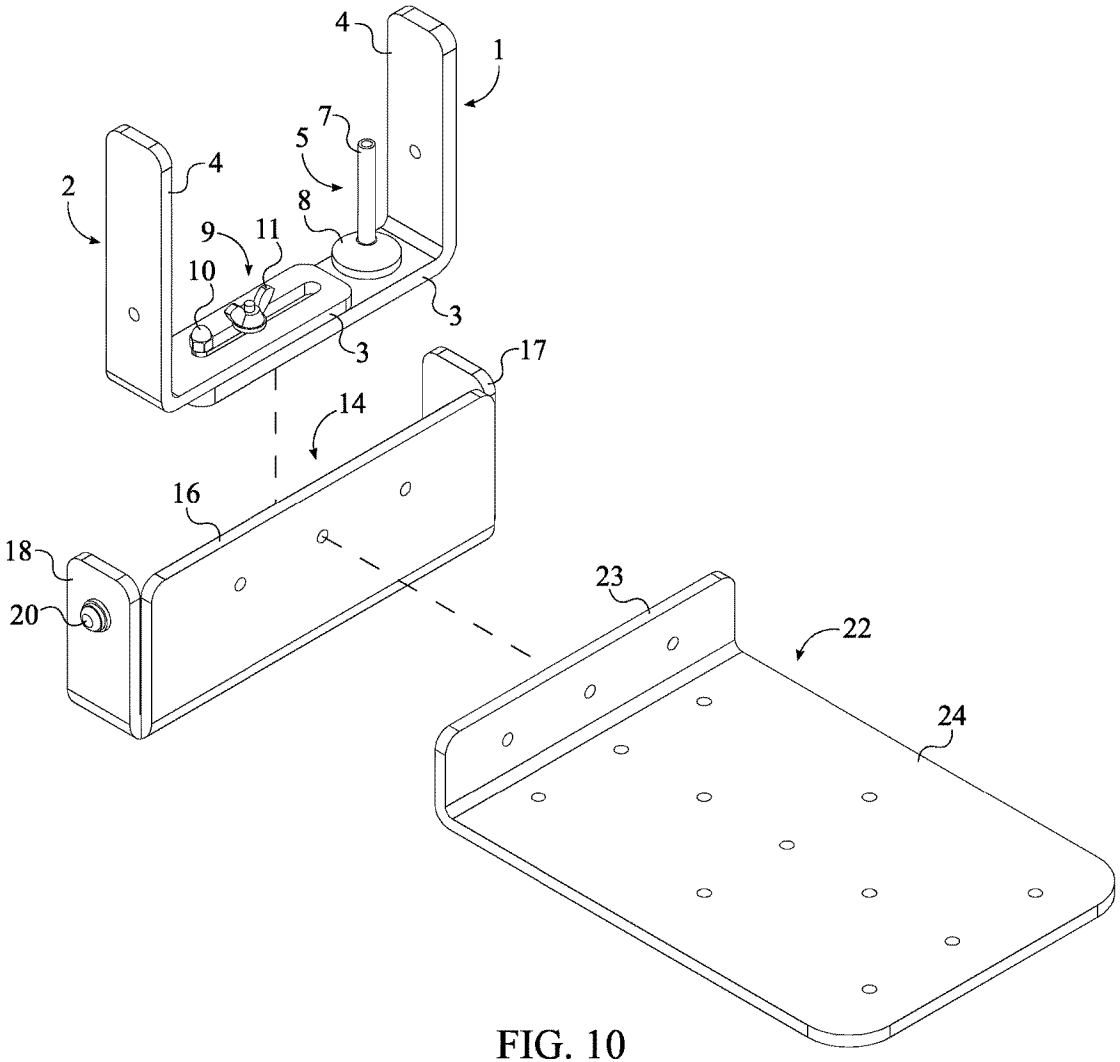
FIG. 10 is an exploded rear perspective view of the present invention with the receiver unit and the angled insert.

In reference to FIGS. 9-10, the present invention further comprises an angled insert 22. The angled insert 22 may be wedged or slid between objects, creating a removable mounting configuration for the firearm. The angled insert 22 comprises an anchor panel 23 and a mounting panel 24. The mounting panel 24 is terminally connected to the anchor panel 23 and is positioned normal to the anchor panel 23. Similar to the support bar 21, the mounting panel 24 is mounted adjacent to the back panel 16. In the preferred embodiment of the present invention, the mounting panel 24 is bolted to the back panel 16, allowing the user to remove the angled insert 22 from the receiver unit 14 if needed. A plurality of panel-mounting holes traverse through the anchor panel 23 and allow the anchor panel 23 to be mounted to the receiver unit 14 in various manners. Depending on the needs of the user, the angled insert 23 may be mounted to the receiver unit 14 through the support bar 21. Alternatively, the support bar 21 may be mounted to the receiver unit 14 through the angled insert 22.

Although the invention has been explained in relation to its preferred embodiment, it is to be understood that many other possible modifications and variations can be made without departing from the spirit and scope of the invention as hereinafter claimed.

What is claimed is:

1. A concealed cargo carry system comprises:

a first L-shaped bracket;

a second L-shaped bracket;

a barrel support;

a bracket-adjustment mechanism;

the first L-shaped bracket and the second L-shaped bracket each comprise a base member and a lateral member;

the lateral member being connected perpendicular to the base member;

the lateral member being terminally positioned on the base member;

the base member of the first L-shaped bracket being slidably engaged with the base member of the second L-shaped bracket through the bracket-adjustment mechanism;

the lateral member of the second L-shaped bracket being positioned opposite to the lateral member of the first L-shaped bracket;

the barrel support being connected perpendicular to the base member of the first L-shaped bracket;

the barrel support being positioned in between the base member of the second L-shaped bracket and the lateral member of the first L-shaped bracket;

the bracket-adjustment mechanism comprises a sliding bolt and a bracket fastener;

the sliding bolt being mounted perpendicular to the base member of the first L-shaped bracket;

the base member of the second L-shaped bracket being slidably engaged with the sliding bolt;

the bracket fastener being engaged with the base member of the first L-shaped bracket and the base member of the second L-shaped bracket;

the barrel support comprises a support rod, a rod grip, and a nose protector;

the support rod being connected perpendicular to the base member of the first L-shaped bracket;

the rod grip being laterally connected around the support rod;

the nose protector being laterally connected around the support rod; and the nose protector being positioned in between the rod grip and the base member of the first L-shaped bracket.

2. The concealed cargo carry system as claimed in claim 1 comprises:

the bracket fastener comprises a locking bolt and a wing nut;

the locking bolt being mounted normal to the base member of the first L-shaped bracket;

the wing nut being engaged with the locking bolt; and the wing nut being positioned adjacent to the base member of the second L-shaped bracket, opposite to the base member of the first L-shaped bracket.

3. The concealed cargo carry system as claimed in claim 1 comprises:

a receiver unit;

the receiver unit comprises a receiver base, a back panel, a first lateral panel, a second lateral panel, a first receiver peg, and a second receiver peg;

the first lateral panel being connected normal to the receiver base;

the second lateral panel being connected normal to the receiver base;

the first lateral panel and the second lateral panel being positioned opposite to each other along the receiver base;

the back panel being connected normal to the receiver base, in between the first lateral panel and the second lateral panel;

the first receiver peg being mounted into the first lateral panel;

the second receiver peg being mounted into the second lateral panel;

the first receiver peg and the second receiver peg being oriented towards each other;

the first receiver peg being engaged with the lateral member of the first L-shaped bracket; and the second receiver peg being engaged with the lateral member of the second L-shaped bracket.

4. The concealed cargo carry system as claimed in claim 3 comprises:

a support bar; and the support bar being laterally mounted to the back panel.

5. The concealed cargo carry system as claimed in claim 3 comprises:

an angled insert;

the angled insert comprises an anchor panel and a mounting panel;

the mounting panel being terminally connected to the anchor panel;

the mounting panel being positioned normal to the anchor panel; and the mounting panel being mounted adjacent to the back panel.

* * * * *